US007548707B2

(12) United States Patent
Ajiro

(10) Patent No.: US 7,548,707 B2
(45) Date of Patent: Jun. 16, 2009

(54) IMAGE-FORMING APPARATUS, CONTROL APPARATUS, CONTROL METHOD, AND COMPUTER-READABLE MEDIUM

(75) Inventor: Takashi Ajiro, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 173 days.

(21) Appl. No.: 11/762,932

(22) Filed: Jun. 14, 2007

(65) Prior Publication Data

US 2008/0112721 A1 May 15, 2008

(30) Foreign Application Priority Data

Nov. 9, 2006 (JP) ..... 2006-304035

(51) Int. Cl.
*G03G 15/20* (2006.01)

(52) U.S. Cl. ..... 399/70; 399/87

(58) Field of Classification Search ..... 399/38, 399/67, 69, 70, 75, 81, 82, 85, 87, 88
See application file for complete search history.

(56) References Cited

U.S. PATENT DOCUMENTS 5,455,657 A * 10/1995 Takeda ..... 399/37
7,265,852 B2 * 9/2007 Goto et al. ..... 358/1.14

FOREIGN PATENT DOCUMENTS

| | | | |
|---|---|---|---|
| JP | 2006154261 | | 6/2006 |
| JP | 2006-243334 | * | 9/2006 |
| JP | 2008-139949 | * | 6/2008 |

* cited by examiner

*Primary Examiner*—Hoan H Tran
(74) *Attorney, Agent, or Firm*—Gauthier & Connors LLP

(57) ABSTRACT

An image-forming apparatus includes: a receiving unit that receives a request of a user; a fixing unit that heats an unfixed image on a recording medium to thereby fix the same to the recording medium; an executing unit that executes at least one function that consumes electric power other than a fixing function by the fixing unit; and a controller that controls to reserve execution of the other function by the executing unit that is required to execute the request in the case where electric power consumption exceeds a prescribed value because a start-up operation of the fixing unit and the execution of the other function by the executing unit are performed in parallel, and the fixing unit is used to execute the received request during the start-up operation that raises the temperature of the fixing unit to a prescribed target temperature with a prescribed amount of electric power.

20 Claims, 4 Drawing Sheets

IMAGE-FORMING APPARATUS, CONTROL APPARATUS, CONTROL METHOD, AND COMPUTER-READABLE MEDIUM

CROSS-REFERENCE TO RELATED APPLICATIONS

This application is based on and claims priority under 35 USC 119 from Japanese Patent Application No. 2006-304035 filed on Nov. 9, 2006.

BACKGROUND

1. Technical Field

An aspect of the present invention relates to an image-forming apparatus, a control apparatus, a control method, and a computer-readable medium.

2. Related Art

There is provided an image-forming apparatus which heats an unfixed image on a recording medium such as paper and fixes the same on the recording medium by means of a fixing apparatus.

SUMMARY

According to an aspect of the present invention, there is provided an image-forming apparatus including: a receiving unit that receives a request of a user; a fixing unit that heats an unfixed image on a recording medium to thereby fix the same to the recording medium; an executing unit that executes at least one function that consumes electric power other than a fixing function by the fixing unit; and a controller that controls to reserve execution of the other function by the executing unit that is required to execute the request in the case where electric power consumption exceeds a prescribed value-because a start-up operation of the fixing unit and the execution of the other function by the executing unit are performed in parallel, and the fixing unit is used to execute the request received by the receiving unit during the start-up operation that raises the temperature of the fixing unit to a prescribed target temperature with a prescribed amount of electric power.

BRIEF DESCRIPTION OF THE DRAWINGS

Exemplary embodiments of the present invention will be described in detail by reference to the following figures, wherein.

DETAILED DESCRIPTION

An exemplary embodiment of the present invention will be described below by reference to the drawings.

Figure 1:
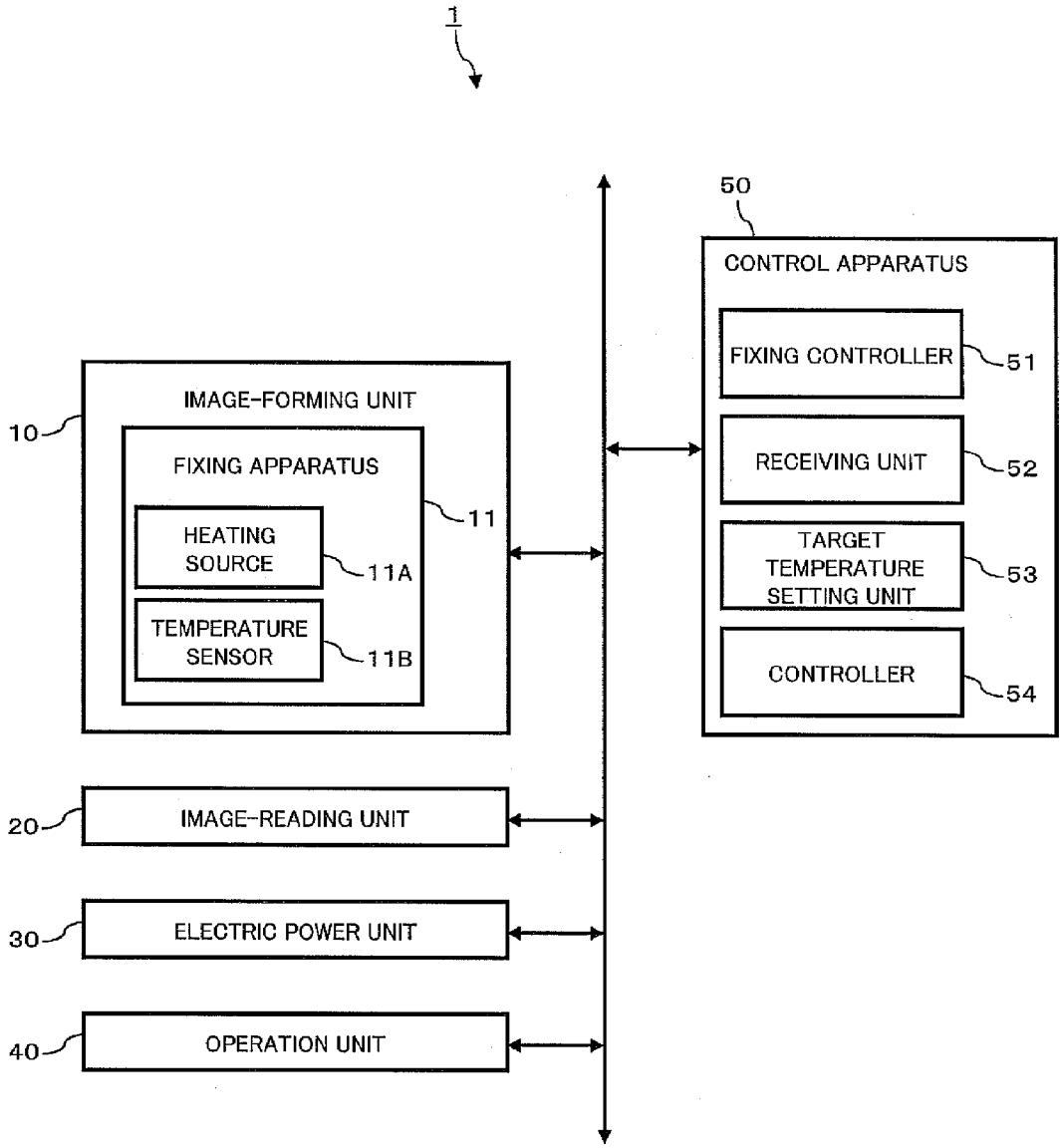
FIG. 1 is a block diagram which illustrates an example configuration of an image-forming apparatus according to the exemplary embodiment of the present invention.

FIG. 1 is a block diagram which illustrates an example configuration of an image-forming apparatus 1 according to the exemplary embodiment of the present invention. This image-forming apparatus 1 has a fixing unit which heats an unfixed image on the recording medium such as paper and fixes the same on the recording medium, and an executing unit which executes at least one function consuming electric power other than a fixing function performed by the fixing unit. Among the above-mentioned other functions, the image-forming apparatus 1 has an image-reading function which reads an image of an original.

As shown in FIG. 1, the image-forming apparatus 1 includes an image-forming unit 10, an image-reading unit 20, an electric power unit 30, an operation unit 40, and a control apparatus 50.

The image-forming unit 10 includes a fixing apparatus 11 that heats the unfixed image on the recording medium such as paper and fixes the same on the recording medium, and realizes an image-forming function which forms an image on the recording medium by means of the fixing apparatus 11. The image-forming unit 10 is, for example, a printer engine of the electronic photograph method, and performs the image forming as follows. The image-forming unit 10 has image-holding material such as photoreceptor, forms a latent image on the image-holding material, develops the latent image by means of toner, transfers onto the recording medium a toner image formed on the image-holding material, and heats the unfixed toner image transferred on the recording medium, to thereby fix the same on the recording medium by means of the fixing apparatus 11.

The fixing apparatus 11 includes a heating source 11A which heats with electric power supplied from the electric power unit 30, and fixes the unfixed image on the recording medium with the heat of the heating source 11A. According to the exemplary embodiment of the present invention, the fixing apparatus 11 includes a heating roll in which a heater is built as the heating source 11A, and a pressing roll which contacts and presses the heating roll, and heats and presses the unfixed toner image on the recording medium which is supplied to a contact portion formed between the heating roll and the pressing roll and fixes the same on the recording medium. However, the fixing apparatus 11 may use another method such as a contact method with a belt, an induction heating method, or a film method. In addition, the fixing apparatus 11 includes a temperature sensor 11B for detecting the temperature of the fixing apparatus 11 (e.g. the surface temperature of the heating roll).

The image-reading unit 20 realizes the image-reading function which reads an image of an original. This image-reading unit 20 is supplied with electric power from the electric power unit 30 and operates with the electric power. The image-reading unit 20 is, for example, a scanner which optically reads the image of the original to generate image data, and executes the image reading as follows. The image-reading unit 20 has a light source such as a halogen lamp, radiates the light of the light source onto the original while moving the light source or the original by means of, for example, an electric motor, and generates electronic image data by converting the light reflecting from the original to electric signals by means of optical/electrical conversion elements.

The electric power unit 30 supplies the electric power to the image-forming unit 10 and the image-reading unit 20 on the basis of a control indication from the control apparatus 50. The electric power unit 30 may supply the electric power to functional blocks other than the image-forming unit 10 and the image-reading unit 20, and may supply the electric power to the entirety of the image-forming apparatus 1.

The operation unit 40 receives operation commands from a user. According to the exemplary embodiment of the present invention, the operation unit 40 has a display function for presenting information to the user. The operation unit 40 includes, for example, various operation bottoms, a touch-panel display, and other elements.

The control apparatus 50 controls the entirety of the image-forming apparatus 1. According to the exemplary embodiment of the present invention, the control apparatus 50 includes a CPU (Central Processing Unit), ROM (Read Only Memory), a main memory, an external storage apparatus, and other elements. Control programs stored in a storage medium are read to the main memory and are executed by the CPU, so that each function of the control apparatus 50 is realized. The above control programs may be also provided as stored in a storage medium such as CD-ROM, and may be also provided through a communication unit. Meanwhile, all or a portion of the functions of the control apparatus 50 may be realized solely by hardware.

The control apparatus 50 includes a fixing controller 51, a receiving unit 52, a target temperature setting unit 53, and a controller 54.

The fixing controller 51 controls the electric power of the electric power unit 30 which is supplied to the heating source 11A of the fixing apparatus 11, on the basis of the temperature detected by the temperature sensor 11B of the fixing apparatus 11 (hereinafter, referred to as "detected temperature"). Specifically, when the fixing apparatus 11 is started up to the fixable state, for example, the electric power is applied or the energy-saving mode is released, the fixing controller 51 supplies the prescribed electric power to the heating source 11A (hereinafter referred to as "start-up electric power") to raise the detected temperature to the prescribed target temperature. In the following descriptions, the operation which raises the temperature of the fixing apparatus 11 to the prescribed target temperature with the prescribed electric power is referred to as "start-up operation." This start-up operation is also referred to as a warm-up operation. After completion of the start-up operation, the fixing controller 51, for example, controls the electric power supplied to the heating source 11A to control the detected temperature to be the prescribed setting temperature.

The above target temperature is the fixable temperature in the exemplary embodiment of the present invention. However, the above target temperature may be set to a prescribed temperature which is lower than the fixable temperature. A prescribed temperature which is lower than the fixable temperature refers to a temperature which can be raised to the fixable temperature with electric power which is lower than the start-up electric power (for example, the electric power which is less than one-half of the start-up electric power) before the fixing operation is executed by the fixing apparatus 11 (for example, before the recording medium reaches the contact portion formed between the heating roll and the pressing roll) after the temperature has been raised to the target temperature which is lower than the fixable temperature with the start-up electric power.

In the exemplary embodiment, the above target temperature is dynamically set in consideration of various conditions. The various conditions refer to, among others, the number of the recording media to be subjected to image-forming, the kind of the recording medium to be subjected to image-forming (size, thickness, material), the orientation of the recording medium to be subjected to image-forming, the ambient temperature, and the temperature detected at the start of the start-up operation. However, the above target temperature may be set previously and statically.

The above setting temperature is the fixable temperature during the fixing operation (for example, while the recording medium is passing through the contact portion formed between the heating roll and the pressing roll), and is the fixable temperature, or the prescribed temperature which is lower than the fixable temperature during other operations. The prescribed temperature which is lower than the fixable temperature refers to the temperature which can be raised to the fixable temperature with electric power which is lower than the start-up electric power (for example, electric power which is less than one-half of the start-up electric power) before the fixing operation is executed by the fixing apparatus 11 (for example, before the recording medium reaches the contact portion formed between the heating roll and the pressing roll) after the temperature has been raised to the target temperature which is lower than the fixable temperature with the start-up electric power.

The above setting temperature may be dynamically set in consideration of various conditions, and may be set previously and statically. The various conditions are the same as those in the case of setting the above target temperature.

The above energy-saving mode is a mode which saves the electric power consumed by the fixing apparatus 11. In the energy-saving mode, the temperature of the fixing apparatus 11 becomes so much lower than the fixable temperature that the start-up operation is required. In the energy-saving mode, the supply of the electric power for the fixing apparatus 11 may be controlled so that the temperature of the fixing apparatus 11 becomes the prescribed temperature which is lower than the fixable temperature, or may be stopped.

The electric power supplied to the above fixing apparatus 11 may be, for example, controlled by changing the number of heaters to which the electric power is supplied, by changing the duty ratio of the electric power supply for the heaters, or by other methods. The duty ratio refers to a ratio of the supply time or the non-supply time of the electric power per unit time.

The receiving unit 52 receives the request of the user (also referred to as "process request") for the image-forming apparatus 1. In the exemplary embodiment, the above requests are a request for reading an image of an original (i.e. a scan request) and a request for copying the image of the original on the recording medium (i.e. a copy request). In the exemplary embodiment of the present invention, the receiving unit 52 receives the request of a user in response to operation performed by the user of the operation unit 40.

The target temperature setting unit 53 sets the target temperature for the starting-up operation in consideration of various conditions. In the exemplary embodiment of the present invention, if the request received by the receiving unit 52 is a request for image-forming (e.g. a copy request), the target temperature setting unit 53 sets the target temperature in consideration of the number of the recording media to be subjected to image-forming. For example, as the number of the recording media to be subjected to image-forming is fewer, the target temperature setting unit 53 sets the target temperature to be lower. If the request received by the receiving unit 52 is a request for image-forming (e.g. a copy request), the target temperature setting unit 53 sets the target temperature in consideration of the size of the recording medium (e.g. the size of paper). For example, as the size of the recording medium becomes smaller, the target temperature setting unit 53 sets the target temperature to be lower. If the request received by the receiving unit 52 is a request for image-forming (e.g. a copy request), the target temperature setting unit 53 sets the target temperature in consideration of the orientation of the recording medium. The orientation of the recording medium is the orientation of the recording medium with respect to the transport direction of the recording medium. For example, the target temperature setting unit 53 sets the target temperature for A4 landscape to be lower than the target temperature for A4 portrait.

During the start-up operation, if the electric power consumption exceeds the prescribed value because the start-up operation of the fixing apparatus 11 and the execution of the image-reading function by the image-reading unit 20 are performed in parallel, and the request received by the receiving unit 52 is executed by the fixing apparatus 11, then the controller 54 controls to reserve the execution of the image-reading function by the image-reading unit 20 which is necessary for executing the above request. The above-prescribed value refers to, for example, the rated electric power consumption of the image-forming apparatus 1.

In the exemplary embodiment of the present invention, the controller 54 calculates time to complete the request received by the receiving unit 52 in the case where the execution of the image-reading function by the image-reading unit 20 is reserved, and in the case where the electric power applied for the start-up operation of the fixing apparatus 11 is decreased, and the start-up operation and the image-reading function are performed in parallel, respectively. If the case where execution of the image-reading function is reserved requires a shorter time to complete the above request than in the case where the start-up operation and the image-reading function are performed in parallel, the controller 54 controls to reserve the execution of the image-reading function.

In the exemplary embodiment of the present invention, if the fixing apparatus 11 is not used to execute the request received by the receiving unit 52, or in the case where the start-up operation and the image reading function are performed in parallel requires a shorter time to complete the above request than in the case where the execution of the image-reading function is reserved, the controller 54 controls to decrease the electric power applied for the fixing apparatus 11, and performs execution of the image-reading function which is necessary for executing the above request by the image-reading unit 20.

In the exemplary embodiment of the present invention, when the start-up operation is suspended after the execution of the image-reading function has been reserved, the controller 54 controls to perform the reserved execution of the image-reading function. The case where the start-up operation is suspended refers to, for example, the case where the supply of the electric power for the fixing apparatus 11 is stopped; specifically, the case where the cover of the image-forming apparatus 1 is opened.

In the exemplary embodiment of the present invention, in the case where the electric power consumption does not exceed the prescribed value even if the start-up operation and the execution of the image-reading function are performed in parallel, the controller 54 controls to perform the execution of the image-reading function.

The operation of the image-forming apparatus 1 having the above configuration will be described below in the case of operation of the fixing control, the operation of the target temperature setting, and the operation of the request execution, respectively.

Figure 2:
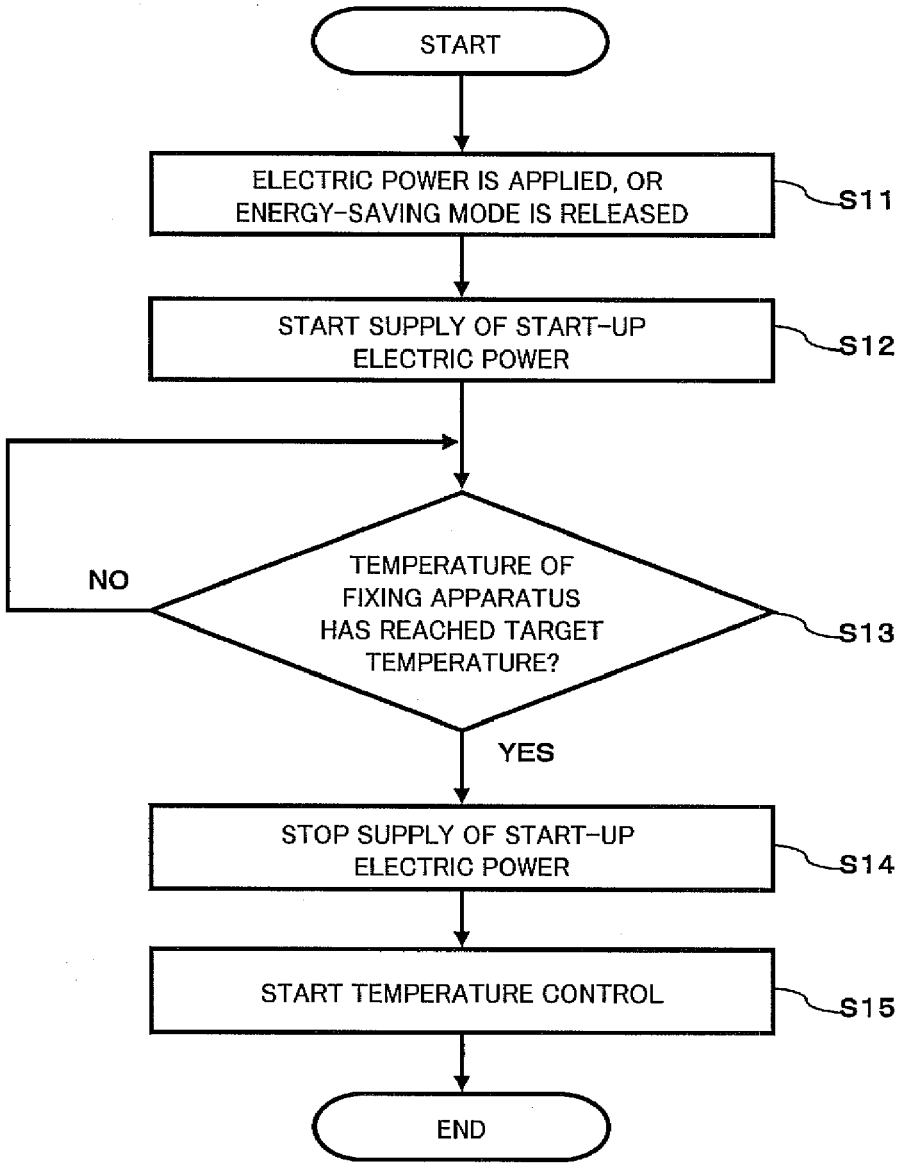
FIG. 2 is a flowchart which illustrates example processing of the fixing control of the image-forming apparatus according to the exemplary embodiment of the present invention.

FIG. 2 is a flowchart which illustrates example processing for fixing control of the image-forming apparatus 1 according to the exemplary embodiment of the present invention. The operation of the fixing control of the image-forming apparatus 1 will be described below by reference to FIG. 2.

If electric power is applied to the image-forming apparatus 1, or if the operation of the releasing indication of the energy-saving mode for the operation unit 40 is executed (S11), the control apparatus 50 controls the electric power unit 30 to start the supply of the start-up electric power for the fixing apparatus 11 (specifically, the heating source 11A) (S12).

The control apparatus 50 maintains the supply of the start-up electric power until the temperature of the fixing apparatus 11 (specifically, the detected temperature of the temperature sensor 11B) reaches the prescribed target temperature (S13: NO).

Then, if the temperature of the fixing apparatus 11 has reached the prescribed target temperature (S13: YES), the control apparatus 50 controls the electric power unit 30 to stop the supply of the start-up electric power for the fixing apparatus 11 (S14), and starts the temperature control for controlling the temperature of the fixing apparatus 11 to the prescribed setting temperature (S15).

Meanwhile, although not illustrated in FIG. 2, if the cover of the image-forming apparatus 1 is opened, the supply of the electric power for the fixing apparatus 11 is stopped. This stopping of the supply of the electric power may be realized by a hard switch which is turned on/off in response to the open/close status of the cover, or may be realized by the control apparatus 50.

Figure 3:
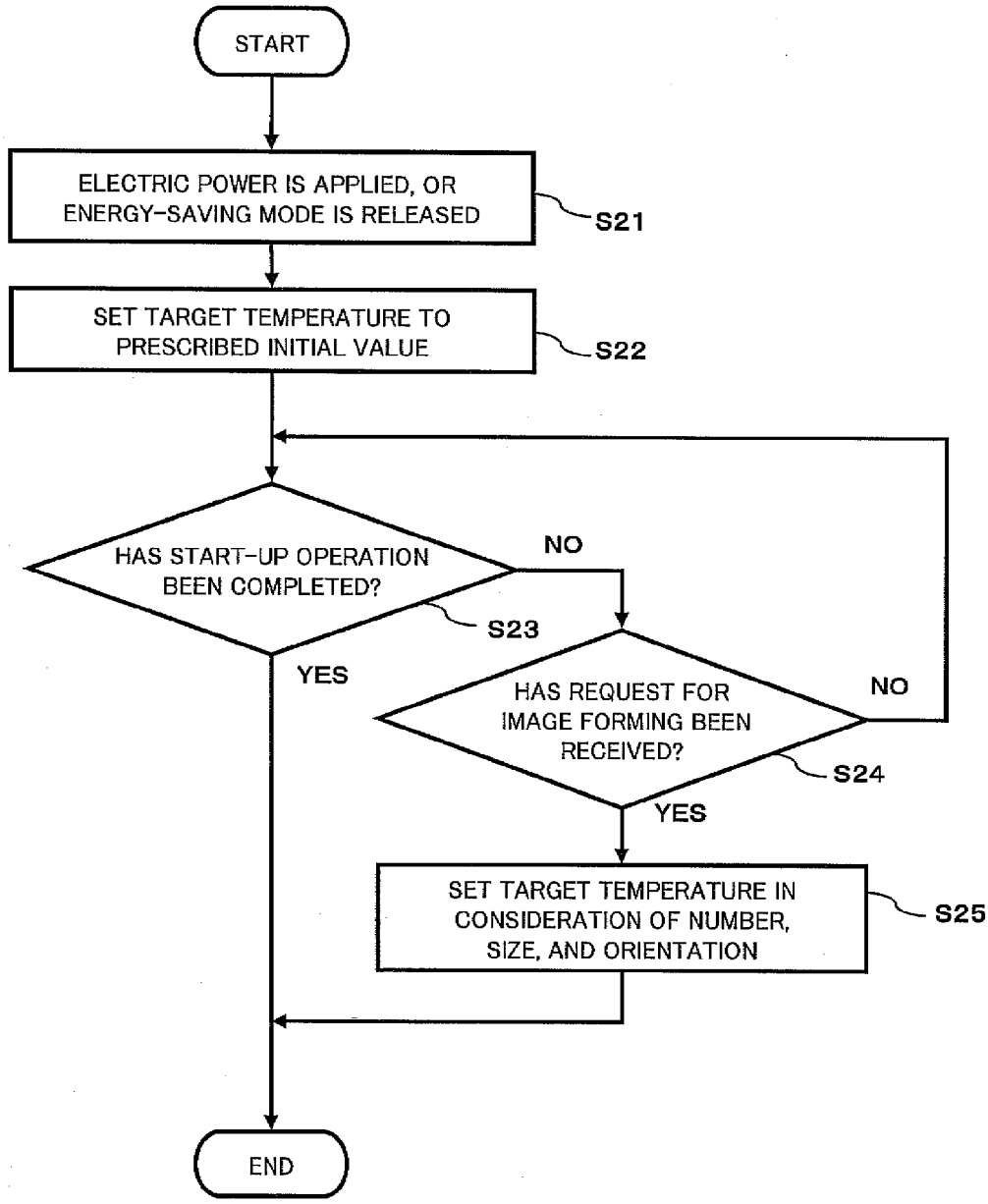
FIG. 3 is a flowchart which illustrates example processing of the target temperature setting of the image-forming apparatus according to the exemplary embodiment of the present invention.

FIG. 3 is a flowchart which illustrates example processing for target temperature setting of the image-forming apparatus 1 according to the exemplary embodiment of the present invention. The operation of the target temperature setting of the image-forming apparatus 1 will be described below by reference to FIG. 3. Meanwhile, the target temperature which is set in the target temperature setting process of FIG. 3 is used for the fixing control of FIG. 2.

If electric power is applied to the image-forming apparatus 1, or if the operation of the releasing indication of the energy-saving mode for the operation unit 40 is executed (S21), the control apparatus 50 sets the target temperature to the prescribed initial value (S22).

Then, the control apparatus 50 determines whether or not the start-up operation has been completed (S23), and if it is determined that the start-up operation has been completed (S23: YES), the process is terminated.

On the other hand, if it is determined that the start-up operation has not been completed (S23: NO); that is, if the start-up operation is currently being executed, the control apparatus 50 determines whether or not a request for image forming has been received (S24), and if it is determined that the request for image forming has not been received (S24: NO), the control apparatus 50 causes processing to return to step S23.

On the other hand, if it is determined that a request for image forming has been received (S24: YES), the control apparatus 50 sets the target temperature in consideration of the number of the recording media to be subjected to image-forming, the size of the recording medium, and the orientation of the recording medium of the request (S25). For example, the control apparatus 50 specifies the setting value which corresponds to the combinations of the number of the recording media to be subjected to image-forming, the size of the recording medium, and the orientation of the recording medium of the request by reference to a previously-prepared table for the target temperature setting, and sets the setting value to the target temperature. In the above table for the target temperature setting, each of the combinations of the number of the recording media to be subjected to image forming, the size of the recording medium, and the orientation of the recording medium corresponds to the setting value of the target temperature.

Figure 4:
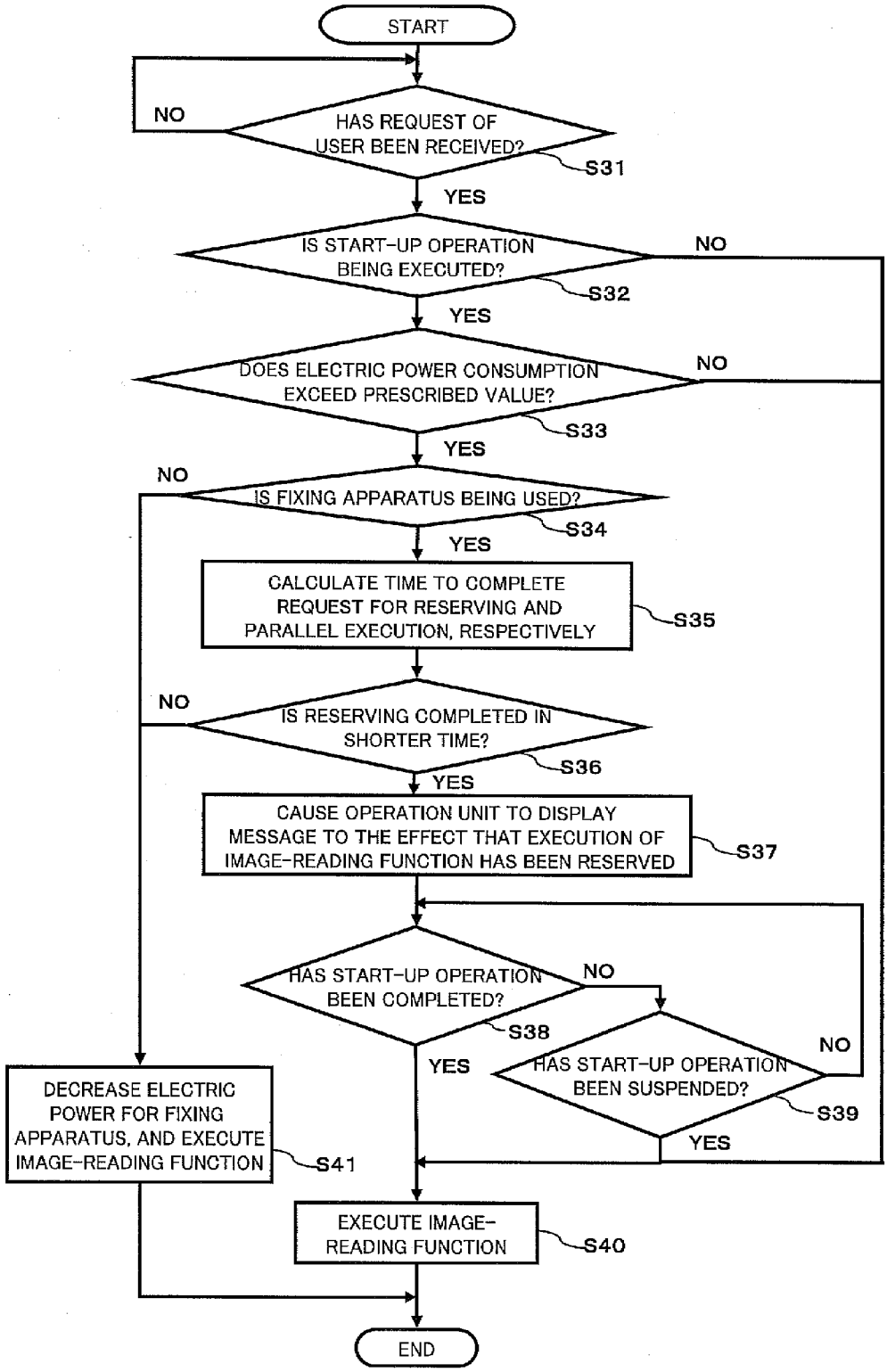
FIG. 4 is a flowchart which illustrates example processing of the request execution of the image-forming apparatus according to the exemplary embodiment of the present invention.

FIG. 4 is a flowchart which illustrates example processing of the request execution of the image-forming apparatus 1 according to the exemplary embodiment of the present invention. The operation of the request execution of the image-forming apparatus 1 will be described below by reference to FIG. 4.

The control apparatus 50 waits until the request of a user (e.g. a scan request or a copy request) is received (S31: NO), and if the request of the user is received (S31: YES), a determination is made as to whether or not the start-up operation is being executed (S32).

Then, if it is determined that the start-up operation is not being executed (S32: NO), the control apparatus 50 causes the process to proceed to step S40.

On the other hand, if it is determined that the start-up operation is being executed (S32: YES), the control apparatus 50 determines whether or not electric power consumption exceeds the prescribed value (e.g. the rated electric power consumption value of the image-forming apparatus 1) because the start-up operation and the execution of the image-reading function are performed in parallel (S33).

Then, if it is determined that the electric power consumption does not exceed the prescribed value (S33: NO), the control apparatus 50 causes the process to proceed to step S40.

On the other hand, if it is determined that the electric power consumption exceeds the prescribed value (S33: YES), the control apparatus 50 determines whether or not the fixing apparatus 11 is being used to execute the request received in step S31 (S34).

Then, if the received request is, for example, a scan request, and it is determined that the fixing apparatus 11 is not being used (S34: NO), the control apparatus 50 causes processing to proceed to step S41.

On the other hand, if the received request is, for example, a copy request, and it is determined that the fixing apparatus 11 is being used (S34: YES), the control apparatus 50 calculates time to complete the request received in step S31 in the case where the execution of the image-reading function is reserved, and in the case where the electric power applied for the starting-up operation is decreased, and the start-up operation and the image-reading function are performed in parallel, respectively (S35).

Then, on the basis of the result of the above calculation, the control apparatus 50 determines whether or not the above request is completed in a shorter time in the case where the execution of the image-reading function is reserved than in the case where the start-up operation and the image-reading function are performed in parallel (S36).

Then, if it is determined that the above request is not completed in a shorter time in the case of reserving than in the case of parallel execution (S36: NO), the control apparatus 50 causes processing to proceed to step S41.

On the other hand, if it is determined that the above request is completed in a shorter time in the case of reserving than in the case of parallel execution (S36: YES), the control apparatus 50 causes the operation unit 40 to display a message to the effect that the execution of the image-reading function has been reserved (or a message to the effect that the request has been reserved) (S37). For example, the control apparatus 50 causes the operation unit 40 to display a message such as [the copy process has been received as a reservation] and [the copy process will be executed after the warm-up process is completed].

Then, the control apparatus 50 decides whether or not the start-up operation has been completed (S38).

Then, if it is determined that the start-up operation has been completed (S38: YES), the control apparatus 50 causes processing to proceed to step S40.

On the other hand, if it is determined that the start-up operation has not been completed (S38: NO), the control apparatus 50 determines whether or not the start-up operation has been suspended (S39).

Then, if it is determined that the start-up operation has been suspended (S39: YES), the control apparatus 50 causes processing to proceed to step S40.

On the other hand, if it is determined that the start-up operation has not been suspended (S39: NO), the control apparatus 50 causes processing to return to step S38.

In step S40, the control apparatus 50 causes the image-reading unit 20 to execute the image-reading function on the basis of the request received in the above step S31. For example, the control apparatus 50 causes the image-reading unit 20 to execute the process of reading the original associated with the copy request or the scan request. At this time, the control apparatus 50 controls the electric power unit 30 to supply the image-reading unit 20 with the electric power required for the image-reading operation.

In step S41, the control apparatus 50 controls the electric power unit 30 to decrease the electric power applied for the start-up operation of the fixing apparatus 11, and causes the image-reading unit 20 to execute the image-reading function on the basis of request received in the above step S31. For example, the control apparatus 50 causes the image-reading unit 20 to execute the process of reading the original associated with the copy request or the scan request. At this time, the control apparatus 50 decreases the electric power applied for the start-up operation of the fixing apparatus 11 so that the electric power consumption does not exceed the prescribed value (e.g. the rated electric power consumption value) even if the start-up operation and the execution of the image-reading function are performed in parallel.

Meanwhile, if the request received in step S31 is the copy request, after the start-up operation of the fixing apparatus 11 has been completed, the process in which the image-forming unit 10 forms the image read by the image-reading unit 20 on the recording medium is executed (i.e., print processing of a scan image).

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling others skilled in the art to understand the invention for various embodiments and with various modifications as are suited to the particular use contemplated. It is intended that the scope of the invention be defined by the following claims and their equivalents.

For example, in the above exemplary embodiment of the present invention, although the scan request and the copy request have been exemplified as the request which requires execution of the image-reading function, another request may be applied. For example, the image-forming apparatus 1 may provide a facsimile transmission function, and may receive a facsimile transmission request as the request which requires execution of the image-reading function.

Moreover, in the above exemplary embodiment of the present invention, although the copy request has been exemplified as the request for image-forming, another request may be applied. For example, the image-forming apparatus 1 may provide a printer function or a facsimile-receiving function, and may receive a printing request of an electronic document and a printing request of a facsimile-receiving document as the request for image forming.

Moreover, although in the above exemplary embodiment of the present invention the control apparatus 50 receives the request through the operation unit 40, it may receive the request in another embodiment. For example, the control apparatus 50 may receive various requests from an external apparatus (e.g. a personal computer) through a communication interface.

In addition, although the start-up electric power may be the predetermined fixed value, it may be determined in consideration of various conditions. The various conditions refer to the situations (when the electric power is applied, when the energy-saving mode is released, after a paper jam is resolved, and others), the target temperature, the ambient temperature, the temperature of the fixing apparatus 11 at the start of the start-up operation, and others.

Moreover, the functions of the image-forming apparatus 1 may be realized by physically separate apparatuses. That is, an image-forming system which realizes the functions of the image-forming apparatus 1 with multiple apparatuses may be constructed. For example, a main body of the image-forming apparatus which includes the image-forming unit 10, the image-reading unit 20, etc. may be physically separated from the control apparatus 50 if they are connected in such a way as to be able to communicate by wire or wireless. Moreover, the functions of the control apparatus 50 may be realized by multiple units (circuit board, etc.).

What is claimed is:

1. An image-forming apparatus comprising:

a receiving unit that receives a request of a user;

a fixing unit that heats an unfixed image on a recording medium to thereby fix the same to the recording medium;

an executing unit that executes at least one function that consumes electric power other than a fixing function by the fixing unit; and a controller that controls to reserve execution of the other function by the executing unit that is required to execute the request in the case where electric power consumption exceeds a prescribed value because a start-up operation of the fixing unit and the execution of the other function by the executing unit are performed in parallel, and the fixing unit is used to execute the request received by the receiving unit during the start-up operation that raises the temperature of the fixing unit to a prescribed target temperature with a prescribed amount of electric power.

2. The image-forming apparatus according to claim 1, wherein the controller calculates time to complete the request received by the receiving unit in the case where the execution of the other function that is performed by the executing unit is reserved, and that in the case where the electric power applied for the start-up operation of the fixing unit is decreased, and the start-up operation and the other function are executed in parallel, respectively, and controls to reserve the execution of the other function if the case where the execution of the other function is reserved requires a shorter time to complete the request than in the case where the start-up operation and the other function are executed in parallel.

3. The image-forming apparatus according to claim 1, wherein if the fixing unit is not used to execute the request received by the receiving unit, or if the case where the start-up operation and the other function are executed in parallel requires a shorter time to complete the request than does the case where the execution of the other function is reserved, the controller controls to decrease the electric power applied for the fixing unit, and perform the execution of the other function that is required to execute the request by the executing unit.

4. The image-forming apparatus according to claim 1, wherein the other function refers to an image-reading function that reads an image of a original.

5. The image-forming apparatus according to claim 1, wherein the controller controls to perform the execution of the other reserved function when the start-up operation has been suspended.

6. The image-forming apparatus according to claim 1, wherein the controller controls to perform the execution of the other function if the electric power consumption does not exceed the prescribed value even if the start-up operation and the execution of the other function are performed in parallel.

7. The image-forming apparatus according to claim 1, wherein the controller sets the target temperature in consideration of the number of the recording media to be subjected to image forming for the request if the request received by the receiving unit is a request for image forming.

8. The image-forming apparatus according to claim 1, wherein the controller sets the target temperature in consideration of the size of the recording medium for the request if the request received by the receiving unit is the request for image forming.

9. The image-forming apparatus according to claim 1, wherein the controller sets the target temperature in consideration of the orientation of the recording medium with respect to the carrying direction of the recording medium for the request if the request received by the receiving unit is the request for image forming.

10. A controller comprising:

a receiving unit that receives a request of a user for an apparatus that has a fixing function that heats a unfixed image on a recording medium with a fixing unit to fix the same to the recording medium and at least one function that consumes electric power other than the fixing function; and a controller that controls to reserve execution of the other function by an executing unit that is required to execute the request in the case where an electric power consumption exceeds a prescribed value because a start-up operation of the fixing unit and the execution of the other function by an executing unit are performed in parallel, and the fixing unit is used to execute the request received by the receiving unit during the start-up operation that raises the temperature of the fixing unit to a prescribed target temperature with a prescribed amount of electric power.

11. The controller according to claim 10, wherein the controller calculates time to complete the request received by the receiving unit in the case where the execution of the other function that is performed by the executing unit is reserved, and in the case where the start-up operation of the fixing unit and the other function are executed in parallel, respectively, and controls to reserve the execution of the other function if the case where the execution of the other function is reserved requires shorter time to complete the request than does the case that the start-up operation and the other function are executed in parallel.

12. The controller according to claim 10, wherein if the fixing unit is not used to execute the request received by the receiving unit, or if the case where the start-up operation and the other function are executed in parallel requires a shorter time to complete the request than does the case where the execution of the other function is reserved, the controller controls to decrease the electric power applied for the fixing unit, and perform the execution of the other function that is required to execute the request by the executing unit.

13. The controller according to claim 10, wherein the other function refers to an image-reading function that reads an image of a original.

14. The controller according to claim 10, wherein the controller controls to perform the execution of the other reserved function when the start-up operation has been suspended.

15. The controller according to claim 10, wherein the controller controls to perform the execution of the other function if the electric power consumption does not exceed the prescribed value even if the start-up operation and the execution of the other function are performed in parallel.

16. The controller according to claim 10, the controller further comprising:

a target temperature setting unit that sets the target temperature in consideration of the number of the recording media to be subjected to image forming for the request if the request received by the receiving unit is the request for image forming.

17. The controller according to claim 10, the controller further comprising:

a target temperature setting unit that sets the target temperature in consideration of the size of the recording medium for the request if the request received by the receiving unit is the request for image forming.

18. The controller according to claim 10, the controller further comprising:

a target temperature setting unit that sets the target temperature in consideration of the orientation of the recording medium with respect to the transport direction of the recording medium for the request if the request received by the receiving unit is the request for image forming.

19. A method for controlling an apparatus, the method comprising:

receiving a request of a user for an apparatus that has a fixing function that heats a unfixed image on a recording medium with a fixing unit to thereby fix the same to the recording medium and at least one function that consumes electric power other than the fixing function; and controlling to reserve execution of the other function by an executing unit that is required to execute the request in the case where electric power consumption exceeds a prescribed value because a start-up operation of the fixing unit and the execution of the other function by the executing unit are performed in parallel, and the fixing unit is used to execute the received request during the start-up operation that raises the temperature of the fixing unit to a prescribed target temperature with a prescribed amount of electric power.

20. A computer-readable medium storing a program causing a computer to execute a process for controlling an apparatus, the process comprising:

receiving a request of a user for an apparatus that has a fixing function that heats a unfixed image on a recording medium with a fixing unit to thereby fix the same to the recording medium and at least one function that consumes electric power other than the fixing function; and controlling to reserve execution of the other function by an executing unit that is required to execute the request in the case where electric power consumption exceeds a prescribed value because a start-up operation of the fixing unit and the execution of the other function by the executing unit are performed in parallel, and the fixing unit is used to execute the received request during the start-up operation that raises the temperature of the fixing unit to a prescribed target temperature with a prescribed amount of electric power.

* * * * *